US006298688B1

(12) United States Patent
Brostow et al.

(10) Patent No.: US 6,298,688 B1
(45) Date of Patent: Oct. 9, 2001

(54) PROCESS FOR NITROGEN LIQUEFACTION

(75) Inventors: Adam Adrian Brostow; Rakesh Agrawal, both of Emmaus; Donn Michael Herron, Fogelsville; Mark Julian Roberts, Kempton, all of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/415,996

(22) Filed: Oct. 12, 1999

(51) Int. Cl.[7] ..... F25J 3/00
(52) U.S. Cl. ..... 62/613; 62/619
(58) Field of Search ..... 62/606, 611, 612, 62/613

(56) References Cited

U.S. PATENT DOCUMENTS

| | | | | |
|---|---|---|---|---|
| 3,511,058 | | 5/1970 | Becker | 62/9 |
| 3,581,511 | * | 6/1971 | Peck | 62/612 |
| 3,690,114 | | 9/1972 | Swearingen et al. | 62/40 |
| 3,733,845 | * | 5/1973 | Lieberman | 62/335 |
| 3,747,359 | | 7/1973 | Streich | 62/24 |
| 3,763,658 | | 10/1973 | Gaumer, Jr. et al. | 62/40 |
| 4,251,247 | | 2/1981 | Gauberthier et al. | 62/9 |
| 4,274,849 | | 6/1981 | Garier et al. | 62/9 |
| 4,375,367 | | 3/1983 | Prentice | 62/13 |
| 4,525,185 | | 6/1985 | Newton | 62/11 |
| 4,778,497 | | 10/1988 | Hanson et al. | 62/11 |
| 4,894,076 | | 1/1990 | Dobracki et al. | 62/9 |
| 5,141,543 | | 8/1992 | Agrawal et al. | 62/8 |
| 5,231,835 | | 8/1993 | Beddome et al. | 62/9 |
| 5,271,231 | | 12/1993 | Ha et al. | 62/39 |
| 5,657,643 | | 8/1997 | Price | 62/612 |
| 5,836,173 | | 11/1998 | Lynch | 62/613 |
| 5,943,881 | | 8/1999 | Grenier | 62/612 |
| 6,041,620 | | 3/2000 | Olszewski et al. | 62/612 |
| 6,041,621 | | 3/2000 | Olszewski et al. | 62/613 |
| 6,065,305 | | 5/2000 | Arman et al. | 62/613 |

FOREIGN PATENT DOCUMENTS

| | | | |
|---|---|---|---|
| 0286314 | 10/1988 | (EP) | F25J/3/04 |
| 2326464 | 3/2000 | (GB) | F25B/39/04 |

OTHER PUBLICATIONS

"Cryogenic Engineering", edited by B. A. Hands, Academic Press Inc., London 1986.
"Cryogenic Process Engineering" by K. D. Timmerhaus and T. M. Flynn, Plenum Press, New York 1989.

* cited by examiner

*Primary Examiner*—Ronald Capossela
(74) *Attorney, Agent, or Firm*—John M. Fernbacher

(57) ABSTRACT

A process for gas liquefaction, particularly nitrogen liquefaction, which combines the use of a nitrogen autorefrigeration cooling cycle with one or more closed-loop refrigeration cycles using two or more refrigerant components. The closed-loop refrigeration cycle or cycles provide refrigeration in a temperature range having a lowest temperature between about −125° F. and about −250° F. A nitrogen expander cycle provides additional refrigeration, a portion of which is provided at temperatures below the lowest temperature of the closed-loop or recirculating refrigeration cycle or cycles. The lowest temperature of the nitrogen expander cycle refrigeration range is between about −220° F. and about −320° F. The combined use of the two different refrigerant systems allows each system to operate most efficiently in the optimum temperature range, thereby reducing the power consumption required for liquefaction.

14 Claims, 9 Drawing Sheets

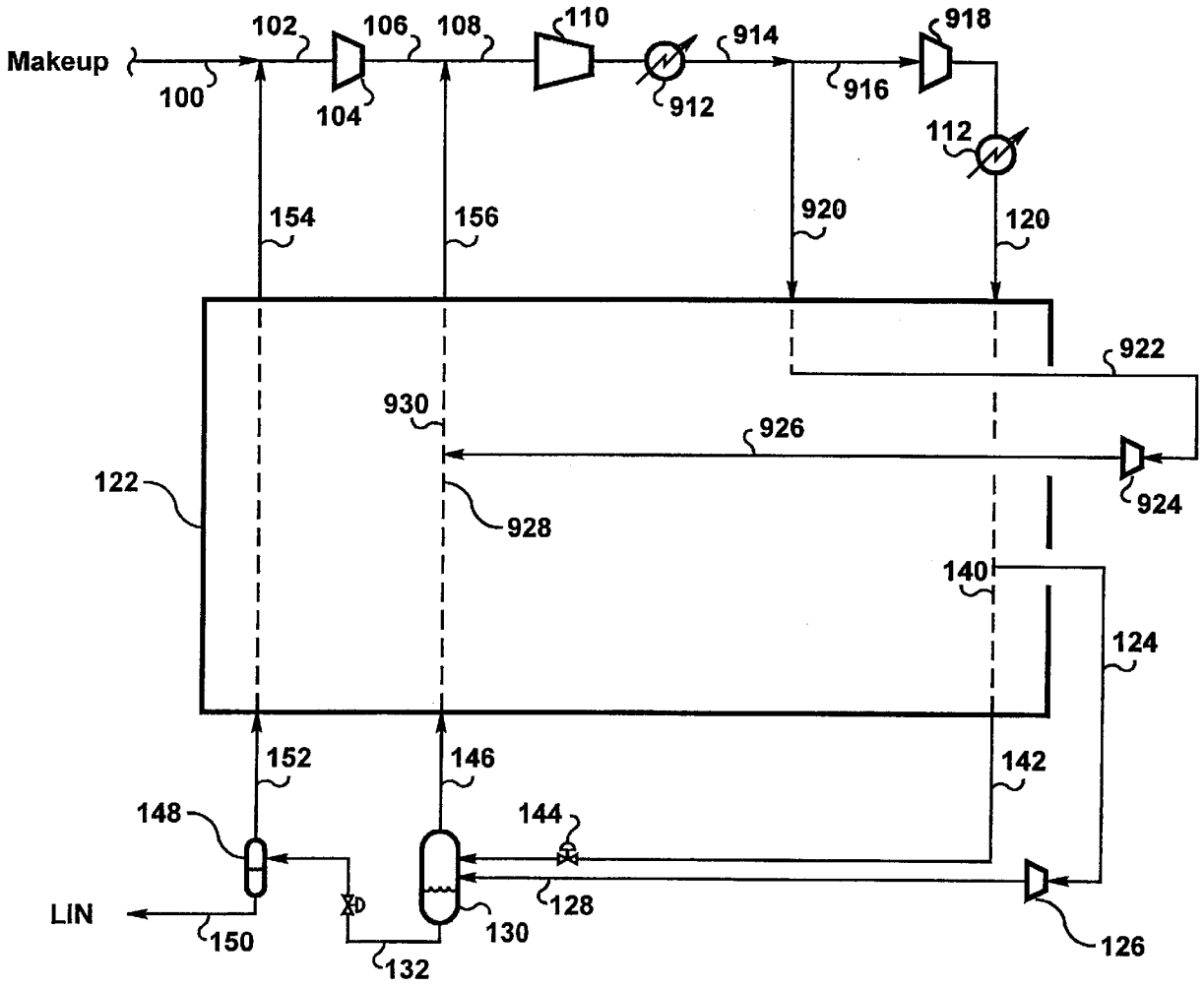
FIGURE 9 - Prior Art

PROCESS FOR NITROGEN LIQUEFACTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The liquefaction of low-boiling gases at temperatures far below ambient is achieved by cryogenic refrigeration systems which utilize selected refrigerants to reach the required condensation temperatures of the liquefied gases. Appropriate refrigerants and refrigeration cycles for such systems can be selected to minimize the power requirements in energy-intensive liquefaction processes. Cryogenic processes for the liquefaction of low-boiling gases such as helium, hydrogen, methane, and nitrogen are well-known in the art.

Refrigeration for the liquefaction of these gases typically utilizes several types of refrigeration systems, often in combination, to cool feed gas to its condensation temperature. External closed-loop refrigeration systems are used which transfer heat indirectly from the gas to be liquefied. Autorefrigeration, in which the gas being liquefied is cooled directly by throttling or work expansion, is also utilized for the lowest-boiling gases such as helium, hydrogen, and nitrogen. Combinations of closed-loop refrigeration and autorefrigeration systems are used to achieve higher process efficiency.

A typical nitrogen liquefaction process compresses warm nitrogen gas to one or more pressure levels, cools the compressed gas, and work expands portion of the cooled compressed gas in one or more turbo-expanders to provide the refrigeration for liquefaction. The cooling effect produced by this work expansion step is defined as autorefrigeration. The remaining portion of the compressed gas is cooled in a heat exchanger against the cold turbo-expander discharge stream or streams, reduced in pressure, and recovered as a liquid. The use of multiple expanders which operate over different temperature levels, and often different pressure levels, improves the efficiency of the process by providing refrigeration at the most appropriate locations of the heat exchanger. The desired result is lower compressor power consumption. There are numerous examples in the art of nitrogen liquefiers of the turbo-expander type. U.S. Pat. No. 5,836,173 illustrates a single turbo-expander cycle; U.S. Pat. No. 4,778,497 and U.S. Pat. No. 5,231,835 illustrate dual turbo-expander cycles; and U.S. Pat. No. 4,894,076 and U.S. Pat. No. 5,271,231 illustrate triple turbo-expander cycles.

A typical two-expander nitrogen liquefier is shown on FIG. 16.15 of "Cryogenic Engineering" edited by B. A. Hands, Academic Press, Inc., London 1986. Refrigeration is provided by two turbo-expanders operating over two temperature levels. As illustrated in this reference, additional refrigeration at the warmest temperature level can be provided by precooling the pressurized nitrogen stream in a chiller. Such a chiller, which is typically a closed-loop freon or ammonia refrigeration unit, was commonly used in nitrogen liquefiers built through the nineteen-eighties. The use of precooling also is disclosed in U.S. Pat. No. 4,375,367. Improvements in turbo-expander efficiencies and environmental restrictions on the use of certain refrigerants have reduced the applicability of such precooling approaches. Furthermore, the temperature level achievable by precooling is modest, typically not below about −40° F. (−40° C.).

Refrigeration may be available from an external source in certain situations. This refrigeration can be used, for example, to provide precooling and refrigeration for the liquefaction of nitrogen. An example application is refrigeration obtained from the warming and vaporization of liquefied natural gas (LNG) for distribution and use. U.S. Pat. No. 5,139,547 discloses the use of refrigeration from vaporizing LNG in the liquefaction of nitrogen. Nitrogen liquefaction cycles based only on using refrigeration from LNG are not very efficient since the normal boiling point of methane is −260° F. and the normal boiling point of nitrogen is −320° F. U.S. Pat. No. 5,141,543 acknowledges this by disclosing the use of a supplemental nitrogen turbo-expander for providing refrigeration at the coldest temperatures. A striking feature of U.S. Pat. Nos. 5,139,547 and 5,141,543 is that much of the refrigeration from the vaporizing LNG is used to allow nitrogen compression at cold temperatures. This occurs because the LNG, being primarily a pure component and being vaporized at a single pressure, provides a disproportionate amount of refrigeration over a relatively narrow temperature range.

Typical natural gas liquefiers use closed-loop refrigeration cycles. The most popular of these cycles employ a mixture of components for the circulating fluid. In these processes, a multicomponent or mixed refrigerant is compressed, condensed, cooled, reduced in pressure, and vaporized. The vaporization of the mixed refrigerant provides the refrigeration needed to liquefy the pressurized natural gas. Multiple pressure levels and composition ranges often are employed for the mixed refrigerant to provide refrigeration at the most appropriate temperature levels and locations in the heat exchanger.

Numerous types of closed-loop mixed refrigerant processes are known in the art. U.S. Pat. No. 5,657,643 discloses a relatively simple single mixed refrigerant cycle which is used specifically for natural gas liquefaction or in general for cooling a fluid. Other examples of single mixed refrigerant cycles include U.S. Pat. Nos. 3,747,359 and 4,251,247. The efficiency of single mixed refrigerant cycles is limited because the required refrigeration for feed gas liquefaction must be provided over a temperature range greater than that achievable in a single mixed refrigerant cycle. In other words, it is difficult to produce a single composition of mixed refrigerant components which can efficiently provide refrigeration over a temperatures range of ambient to −260° F.

The more efficient closed-loop mixed refrigerant processes use multiple refrigerant cycles to span the required temperature range more efficiently. One popular type is the propane-precooled mixed refrigerant cycle, an example of which is disclosed in U.S. Pat. No. 3,763,658. A first refrigeration loop uses propane to precool a mixed refrigerant in a second refrigeration loop, and also the natural gas feed, to approximately −40° F. Other types of multiple refrigerant cycles use two different mixed refrigerant loops operating at different temperatures. These cycles, often termed "dual-mixed refrigerant" cycles, are described in U.S. Pat. Nos. 4,274,849 and 4,525,185. A third type of multiple refrigerant cycle is called a "cascade" cycle which typically uses three refrigeration loops. The warmest loop employs propane as the working fluid, the coldest loop employs methane as the working fluid, and the intermediate temperature loop uses either ethane or ethylene as the working fluid. FIG. 4.19 in "Cryogenic Process Engineering" by K. D. Timmerhaus and T. M. Flynn, Plenum Press, New York 1989 briefly describes this cycle.

Although it is theoretically possible to liquefy nitrogen by using the closed loop mixed refrigerant cycles employed to liquefy natural gas, the efficiency of such cycles would be less than desired because these mixed refrigerant systems are inefficient in supplying refrigeration at the low temperatures required to liquefy nitrogen. Improved nitrogen liquefaction processes are desirable which are more economical and efficient than the conventional processes discussed above. It is the objective of the present invention, as described below and defined by the claims which follow, to provide an improved nitrogen liquefaction process which combines autorefrigeration with one or more closed-loop multicomponent refrigeration systems.

BRIEF SUMMARY OF THE INVENTION

The invention is a method of providing refrigeration for the liquefaction of a feed gas which comprises:

(a) providing a first refrigeration system comprising at least one recirculating refrigerant circuit, wherein the first refrigeration system utilizes a mixed refrigerant comprising two or more components and provides refrigeration in a first temperature range, and operating the first refrigeration system by utilizing steps which include
  - (a1) compressing a gaseous mixed refrigerant to provide a compressed mixed refrigerant;
  - (a2) cooling and at least partially condensing the compressed mixed refrigerant in a first heat exchanger to provide a cooled mixed refrigerant;
  - (a3) further cooling at least a portion of the cooled mixed refrigerant in a second heat exchanger to provide a further cooled mixed refrigerant;
  - (a4) reducing the pressure of the further cooled mixed refrigerant to provide a reduced-pressure mixed refrigerant;
  - (a5) warming and vaporizing the reduced-pressure mixed refrigerant in the second heat exchanger to provide a portion of the refrigeration required for the liquefaction of the feed gas and yield a vaporized mixed refrigerant; and
  - (a6) recirculating the vaporized mixed refrigerant to provide at least a portion of the gaseous mixed refrigerant in (a1); and (b) providing a second refrigeration system in which a cooled and pressurized refrigerant stream is work expanded to generate a cold refrigerant stream, and warming the cold refrigerant stream in the second heat exchanger to provide another portion of the refrigeration required for the liquefaction of the feed gas, wherein the cooled and pressurized refrigerant stream comprises feed gas and has the same composition as the feed gas.

In the first embodiment of the invention, the first refrigeration system comprises a recirculating refrigeration circuit which is operated by steps which include:

(1) compressing a gaseous mixed refrigerant to form a compressed gaseous mixed refrigerant;

(2) cooling and at least partially condensing a first portion of the compressed gaseous mixed refrigerant to form a first cooled mixed refrigerant;

(3) reducing the pressure of the first cooled mixed refrigerant to a first pressure level to form a first reduced-pressure mixed refrigerant;

(4) vaporizing the first reduced-pressure mixed refrigerant of (3) to provide a first portion of the refrigeration in the first temperature range and yield a first vaporized refrigerant;

(5) cooling and at least partially condensing a second portion of the compressed gaseous mixed refrigerant to form a second cooled mixed refrigerant;

(6) reducing the pressure of the second cooled mixed refrigerant to a second level to form a second reduced-pressure mixed refrigerant;

(7) vaporizing the second reduced-pressure mixed refrigerant to provide a second portion of the refrigeration in the first temperature range and form a second vaporized refrigerant;

(8) compressing the second vaporized refrigerant and combining it with the first vaporized refrigerant to form a combined compressed vaporized refrigerant; and (9) further compressing the combined vaporized refrigerant to provide the gaseous mixed refrigerant of (1).

The lowest temperature in the second temperature range preferably is less than the lowest temperature in the first temperature range. The lowest temperature in the first temperature range typically is between about −125° F. and about −250° F., while the lowest temperature in the second temperature range typically is between about −220° F. and about −320° F.

The feed gas can comprise nitrogen, and the nitrogen concentration in the feed gas can be equal to or greater than the concentration of nitrogen in air. The mixed refrigerant can comprise two or more components selected from the group consisting of nitrogen and hydrocarbons containing one or more carbon atoms.

In a second embodiment of the invention, the first refrigeration system comprises a recirculating refrigeration circuit which is operated by steps which include:

(1) compressing a gaseous mixed refrigerant;

(2) cooling, partially condensing, and separating the resulting compressed mixed refrigerant into a liquid refrigerant stream and a vapor refrigerant stream;

(3) further cooling and reducing the pressure of the liquid refrigerant stream to yield a first cooled reduced-pressure refrigerant stream;

(4) cooling, at least partially condensing, and reducing the pressure of the cooled vapor refrigerant stream to yield a second cooled reduced-pressure refrigerant stream;

(5) warming the second cooled reduced-pressure refrigerant stream to provide a portion of the refrigeration in the first temperature range and yield a warmed second reduced-pressure refrigerant stream;

(6) combining the first cooled reduced-pressure refrigerant stream and the warmed second reduced-pressure refrigerant stream, and warming the resulting combined refrigerant stream to provide another portion of the refrigeration in the first temperature range; and (7) recirculating the resulting warmed combined refrigerant stream to provide the gaseous mixed refrigerant of (1).

In a third embodiment of the invention, the first refrigeration system comprises a recirculating refrigeration circuit which is operated by steps which include:

(1) compressing a gaseous mixed refrigerant;

(2) cooling, partially condensing, and separating the resulting compressed mixed refrigerant into a first liquid refrigerant stream and a first vapor refrigerant stream;

(3) further cooling and reducing the pressure of the first liquid refrigerant stream to yield a first cooled refrigerant stream;

(4) cooling and partially condensing the first vapor refrigerant stream, and separating the resulting stream to yield a second liquid refrigerant stream and a second vapor refrigerant stream;

(5) cooling, at least partially condensing, and reducing the pressure of the second vapor refrigerant stream to yield a second cooled refrigerant stream;

(6) warming the second cooled refrigerant stream to provide a portion of the refrigeration in the first temperature range and yield a first warmed refrigerant stream;

(7) combining the first warmed refrigerant stream with the second cooled refrigerant stream, and warming the resulting combined refrigerant stream to provide another portion of the refrigeration in the first temperature range and yield a second warmed refrigerant stream;

(8) combining the second warmed refrigerant stream with first cooled refrigerant stream, and warming the resulting combined refrigerant stream to provide yet another portion of the refrigeration in the first temperature range and yield a third warmed refrigerant stream; and (9) recirculating the third warmed refrigerant stream to provide the gaseous mixed refrigerant of (1).

In a fourth embodiment of the invention, the second recirculating refrigeration circuit is operated by steps which include:

(1) compressing and cooling a first gas stream comprising feed gas to provide a cooled compressed gas stream;

(2) work expanding a first portion of the cooled compressed gas stream to provide at least a portion of the cold refrigerant in (b);

(3) warming the cold refrigerant to provide refrigeration in the second temperature range and yield a warmed refrigerant;

(4) recirculating the warmed refrigerant to provide a portion of the first gas stream in (1);

(5) further cooling a second portion of the cooled compressed gas stream to provide a cold compressed gas stream, reducing the pressure of the cold compressed gas stream to yield a reduced-pressure stream which is at least partially liquefied, introducing the reduced-pressure stream into a separator vessel, and withdrawing a stream of liquefied gas therefrom; and (6) providing another portion of the first gas stream in (1) by a gas makeup stream which comprises feed gas.

Preferably, the lowest temperature in the second temperature range is less than the lowest temperature in the first temperature range. The lowest temperature in the first temperature range can be between about −125° F. and about −250° F. The lowest temperature in the second temperature range typically can be between about −220° F. and about −320° F. The feed gas preferably comprises nitrogen, and the nitrogen concentration in the feed gas can be equal to or greater than the concentration of nitrogen in air.

The lowest temperature in the first temperature range typically is between about −125° F. and −250° F. The mixed refrigerant can comprise two or more components selected from the group consisting of nitrogen and hydrocarbons containing one or more carbon atoms.

In another embodiment, the first refrigeration system comprises a first recirculating refrigeration circuit which is operated by steps which include:

(1a) compressing a first gaseous refrigerant to form a compressed first gaseous refrigerant;

(1b) cooling and at least partially condensing the compressed first gaseous refrigerant to form a first cooled refrigerant;

(1c) reducing the pressure of the first cooled refrigerant to form a reduced-pressure first refrigerant;

(1d) vaporizing the reduced-pressure first refrigerant to provide refrigeration and yield a vaporized first refrigerant; and (1e) recirculating the vaporized first refrigerant to provide the first gaseous refrigerant refrigerant of (1a).

The first refrigeration system also comprises a second recirculating refrigeration circuit which is operated by steps which include:

(2a) compressing a second gaseous refrigerant to form a compressed second gaseous refrigerant;

(2b) cooling and at least partially condensing the compressed second gaseous refrigerant to form a second cooled refrigerant;

(2c) reducing the pressure of the second cooled refrigerant to form a reduced-pressure second refrigerant;

(2d) vaporizing the reduced-pressure second refrigerant to provide refrigeration and yield a vaporized second refrigerant; and (2e) recirculating the vaporized second refrigerant to provide the second gaseous refrigerant of (2a).

The lowest temperature in the second recirculating refrigeration circuit can be less that the lowest temperature in the first recirculating refrigeration circuit. The first gaseous refrigerant and the second gaseous refrigerant each can comprise one or more components selected from the group consisting of nitrogen and hydrocarbons containing one or more carbon atoms.

In another embodiment, the first refrigeration system comprises a recirculating refrigeration circuit which is operated by steps which include:

(1) compressing a gaseous mixed refrigerant to form a compressed gaseous mixed refrigerant;

(2) cooling and at least partially condensing a first portion of the compressed gaseous mixed refrigerant to form a first cooled mixed refrigerant;

(3) reducing the pressure of the first cooled mixed refrigerant to a first pressure level to form a first reduced-pressure mixed refrigerant;

(4) vaporizing the first reduced-pressure mixed refrigerant of (3) to provide a first portion of the refrigeration in the first temperature range and yield a first vaporized refrigerant;

(5) cooling and at least partially condensing a second portion of the compressed gaseous mixed refrigerant to form a second cooled mixed refrigerant;

(6) reducing the pressure of the second cooled mixed refrigerant to a second level to form a second reduced-pressure mixed refrigerant;

(7) vaporizing the second reduced-pressure mixed refrigerant to provide a second portion of the refrigeration in the first temperature range and form a second vaporized refrigerant;

(8) compressing the second vaporized refrigerant and combining it with the first vaporized refrigerant to form a combined compressed vaporized refrigerant; and (9) further compressing the combined vaporized refrigerant to provide the gaseous mixed refrigerant of (1).

The resulting compressed mixed refrigerant can be cooled, partially condensed, and separated into a liquid stream and a vapor stream, wherein the liquid stream provides the first portion of the resulting compressed mixed refrigerant and the vapor stream provides the second portion of the resulting compressed mixed refrigerant. A portion of the liquid stream can be combined with the second portion of the resulting compressed mixed refrigerant.

In a further embodiment, the first refrigeration system can comprise a recirculating refrigeration circuit which is operated by steps which include:

(1) compressing a gaseous mixed refrigerant;

(2) cooling, partially condensing, and separating the resulting compressed mixed refrigerant into a liquid refrigerant stream and a vapor refrigerant stream;

(3) further cooling and reducing the pressure of the liquid refrigerant stream to yield a first cooled reduced-pressure refrigerant stream;

(4) cooling, at least partially condensing, and reducing the pressure of the cooled vapor refrigerant stream to yield a second cooled reduced-pressure refrigerant stream;

(5) warming the second cooled reduced-pressure refrigerant stream to provide a portion of the refrigeration in the first temperature range and yield a warmed second reduced-pressure refrigerant stream;

(6) combining the first cooled reduced-pressure refrigerant stream and the warmed second reduced-pressure refrigerant stream, and warming the resulting combined refrigerant stream to provide another portion of the refrigeration in the first temperature range; and (7) recirculating the resulting warmed combined refrigerant stream to provide the gaseous mixed refrigerant of (1).

In another embodiment, the first refrigeration system can comprise a recirculating refrigeration circuit which is operated by steps which include:

(1) compressing a gaseous mixed refrigerant;

(2) cooling, partially condensing, and separating the resulting compressed mixed refrigerant into a first liquid refrigerant stream and a first vapor refrigerant stream;

(3) further cooling and reducing the pressure of the first liquid refrigerant stream to yield a first cooled refrigerant stream;

(4) cooling and partially condensing the first vapor refrigerant stream, and separating the resulting stream to yield a second liquid refrigerant stream and a second vapor refrigerant stream;

(5) cooling, at least partially condensing, and reducing the pressure of the second vapor refrigerant stream to yield a second cooled refrigerant stream;

(6) warming the second cooled refrigerant stream to provide a portion of the refrigeration in the first temperature range and yield a first warmed refrigerant stream;

(7) combining the first warmed refrigerant stream with the second cooled refrigerant stream, and warming the resulting combined refrigerant stream to provide another portion of the refrigeration in the first temperature range and yield a second warmed refrigerant stream;

(8) combining the second warmed refrigerant stream with first cooled refrigerant stream, and warming the resulting combined refrigerant stream to provide yet another portion of the refrigeration in the first temperature range and yield a third warmed refrigerant stream; and (9) recirculating the third warmed refrigerant stream to provide the gaseous mixed refrigerant of (1).

The second recirculating refrigeration circuit can be operated by steps which include:

(1) compressing and cooling a first gas stream comprising feed gas to provide a cooled compressed gas stream;

(2) work expanding a first portion of the cooled compressed gas stream to provide at least a portion of the cold refrigerant in (b);

(3) warming the cold refrigerant to provide refrigeration in the second temperature range; and (4) recirculating the resulting warmed refrigerant to provide a portion of the first gas stream in (1).

The lowest temperature in the second temperature range typically is between about −220° F. and −320° F. Another portion of the first gas stream in (1) can be provided by a gas makeup stream which comprises feed gas.

A second portion of the cooled compressed gas stream can be further cooled to provide a cold compressed gas stream, and the pressure of the cold compressed gas stream can be reduced to yield a reduced-pressure stream which is at least partially liquefied. The reduced-pressure stream can be introduced into a separator vessel, from which a stream of liquefied gas can be withdrawn. The resulting work-expanded gas in (2) also can be introduced into the separator vessel, and a vapor stream can be withdrawn therefrom to provide at least a portion of the cold refrigerant of (b).

The pressure of the stream of liquefied gas can be reduced, the resulting reduced-pressure stream introduced into another separator vessel, a final liquefied gas product and a cold vapor stream withdrawn therefrom, and the cold vapor stream warmed to provide another portion of the total refrigeration for liquefaction of the feed gas. The resulting warmed vapor stream can be combined with the feed gas, and the resulting combined gas stream then compressed to provide the gas makeup stream.

The work generated by work expanding the first portion of the cooled compressed gas stream in (2) can provide a portion of the work to compress the first gas stream in (1).

The compression of the gaseous mixed refrigerant in (1) can be effected in a multiple stage compressor with interstage cooling in which at least one interstage condensate stream is withdrawn from a given stage, pumped to a higher pressure, and combined with a discharge stream from a subsequent compressor stage. Alternatively, the compression of the gaseous mixed refrigerant in (1) can be effected in a multiple stage compressor with interstage cooling in which no interstage condensate is formed.

BRIEF DESCRIPTION OF SEVERAL VIEWS OF THE DRAWINGS

FIG. 9 is a schematic flow diagram of a prior art nitrogen liquefier cycle.

DETAILED DESCRIPTION OF THE INVENTION

The present invention is a nitrogen liquefaction process which combines the use of a autorefrigeration cooling cycle with one or more closed-loop refrigeration cycles using two or more refrigerant components. The closed-loop or recirculating refrigeration cycle or cycles provide refrigeration over a temperature range having a lowest temperature between about −45° F. and about −250° F., preferably between about −125° F. and about −250° F. A nitrogen expander cycle provides additional refrigeration, a portion of which is provided at temperatures below the lowest temperature of the closed-loop or recirculating refrigeration cycle or cycles. While the invention is illustrated below for the liquefaction of nitrogen, other low-boiling gases, including air, could be liquefied using the basic principles of the invention.

Figure 1:
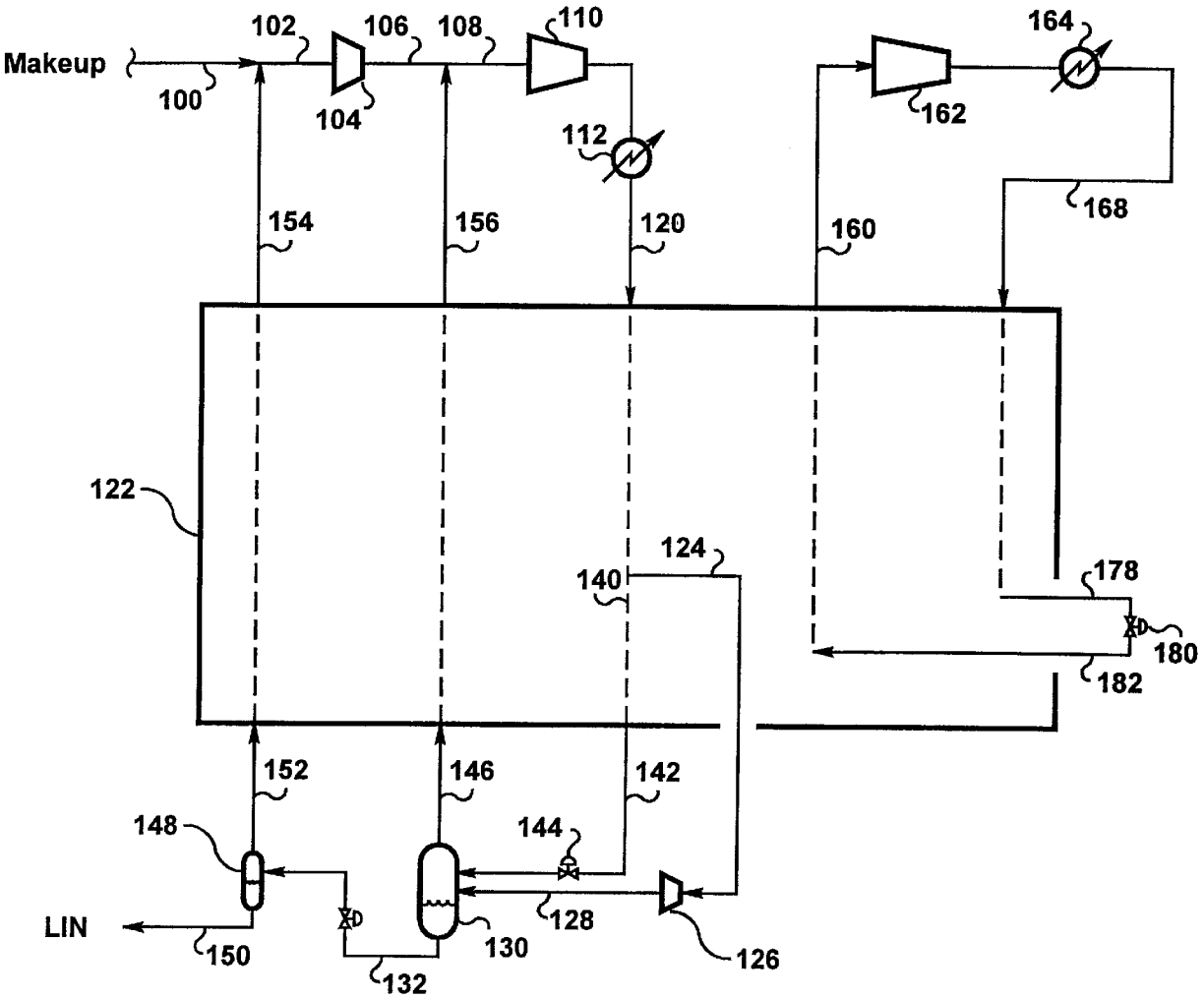
FIG. 1 is a schematic flow diagram of an embodiment of the invention which utilizes a nitrogen expander cycle and a closed-loop mixed refrigerant cycle to provide refrigeration for liquefying nitrogen.

One embodiment of the invention is shown in FIG. 1. Low-pressure nitrogen makeup feed gas 100 is combined with low-pressure nitrogen recycle stream 154 to form stream 102. Stream 102 is compressed in makeup compressor 104 to form stream 106, which is then combined with medium pressure nitrogen recycle stream 156 to form stream 108. Stream 108 is compressed in recycle compressor 110, cooled in aftercooler 112 to form stream 120, and is introduced into liquefaction heat exchanger 122. Stream 120 is cooled to a temperature between the cold-end and warm-end temperatures of heat exchanger 122, and is split into stream 124 and stream 140. Stream 124 is work expanded in turbo-expander 126 to form expanded stream 128 which is introduced into medium-pressure phase separator 130. Stream 140 is further cooled to produce stream 142 at a temperature typically below its critical temperature, reduced in pressure across valve 144, and introduced into medium-pressure phase separator 130.

Vapor stream 146 from medium-pressure phase separator 132 is warmed in liquefaction heat exchanger 122 to provide refrigeration therein and produce medium-pressure nitrogen recycle stream 156. Liquid stream 132 from medium-pressure phase separator 130 is further reduced in pressure and directed into low-pressure phase separator 148. Vapor stream 152 from the low-pressure phase separator is warmed in liquefaction heat exchanger 122 to provide additional refrigeration therein and produce low-pressure nitrogen recycle stream 158. Liquid stream 150 from low-pressure phase separator 148 constitutes the liquid nitrogen product.

Mixed refrigerant recycle vapor stream 160, which typically is a mixture of hydrocarbons and may contain some low-boiling components such as nitrogen, is compressed in mixed-refrigerant compressor 162, at least partially and preferably totally condensed in exchanger 164, and introduced to liquefaction heat exchanger 122 as stream 168. Stream 168 is cooled in liquefaction heat exchanger 122 to produce stream 178 which is subsequently reduced in pressure across throttling valve 180 to produce stream 182. Reduced-pressure stream 182 typically is at a temperature less than about −45° F., and more preferably less than about −125° F. Stream 182 is vaporized and warmed in liquefaction heat exchanger 122 to produce refrigeration therein and yield mixed refrigerant recycle stream 160. Compressors 104, 110, and 162 are typically multiple-stage compressors with intercoolers, which are not shown in the drawings for simplicity. The embodiment of FIG. 1 is a low-cost implementation of the invention.

Figure 2:
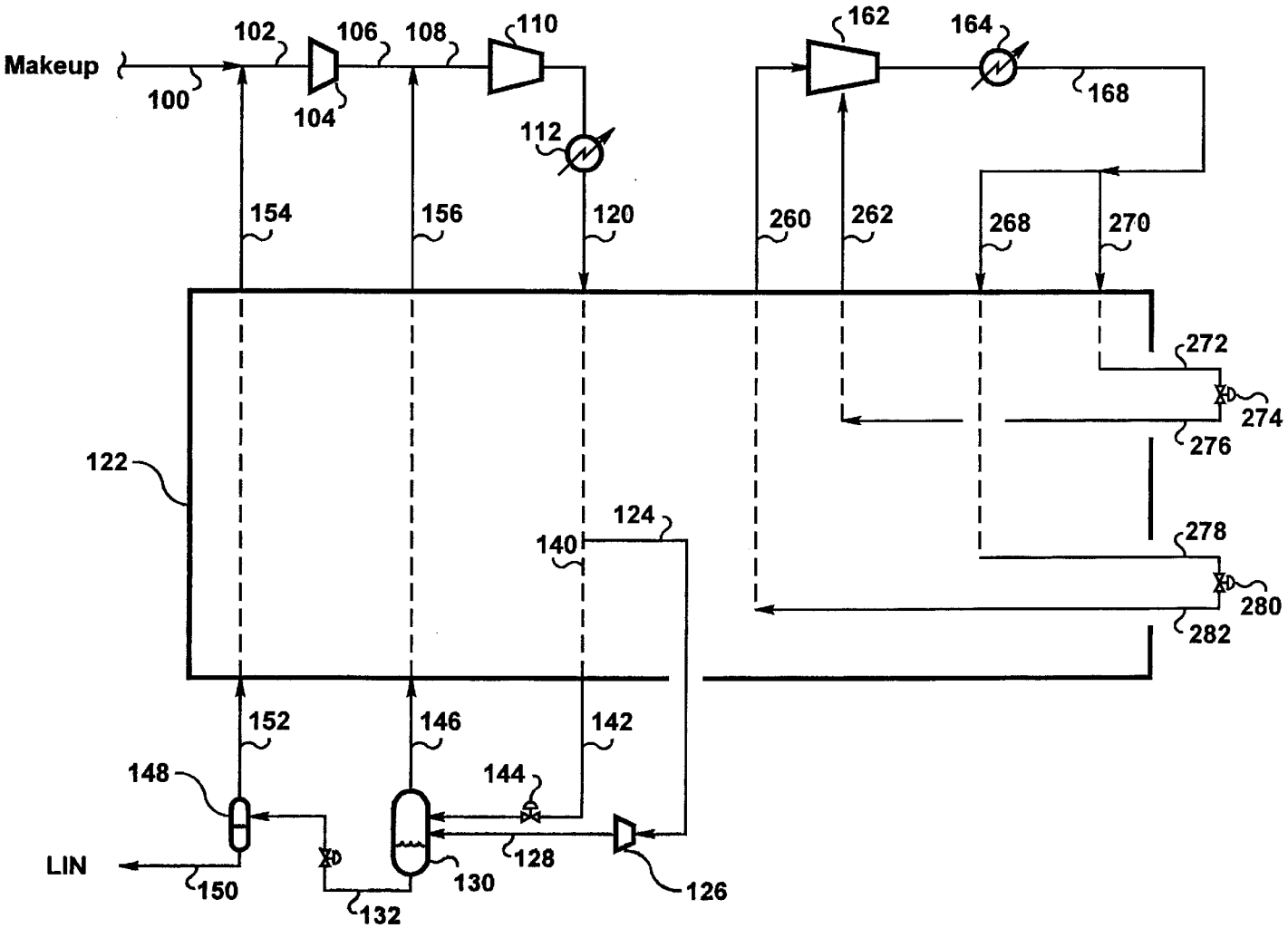
FIG. 2 illustrates another embodiment of the invention in which the closed-loop mixed refrigerant cycle provides refrigeration by vaporizing the refrigerant at two different pressure levels in two separate heat exchange circuits.

Another embodiment of the invention is shown in FIG. 2. The operation of the nitrogen cycle of FIG. 2 is unchanged from the embodiment of FIG. 1 which utilizes items 100 to 156. Compressed and at least partially condensed mixed refrigerant stream 168 is split into two portions, stream 268 and 270. Stream 270 is cooled in exchanger 122 to produce stream 272 and reduced in pressure across valve 274 to form stream 276. Stream 276 is subsequently vaporized and warmed in exchanger 122 to provide refrigeration therein, and is introduced into an interstage location of mixed refrigerant compressor 162 as stream 262.

Stream 268 is cooled in exchanger 122 to a colder temperature than stream 272, to produce stream 278 which is reduced in pressure across valve 280 to a pressure less than that of stream 276. This results in reduced-pressure stream 282, which is temperature of less than about −45° F. and more preferably less than about −125° F. Stream 282 is vaporized and warmed in exchanger 122 to produce additional refrigeration therein, and is introduced to mixed refrigerant compressor 162 as stream 260.

The efficiency of this embodiment is improved over the embodiment of FIG. 1 because the mixed refrigerant is returned to mixed refrigerant compressor 162 at two pressure levels, thereby reducing power. Additional pressure levels may be used, but such an option involves a trade-off between efficiency and capital expenditure.

Figure 3:
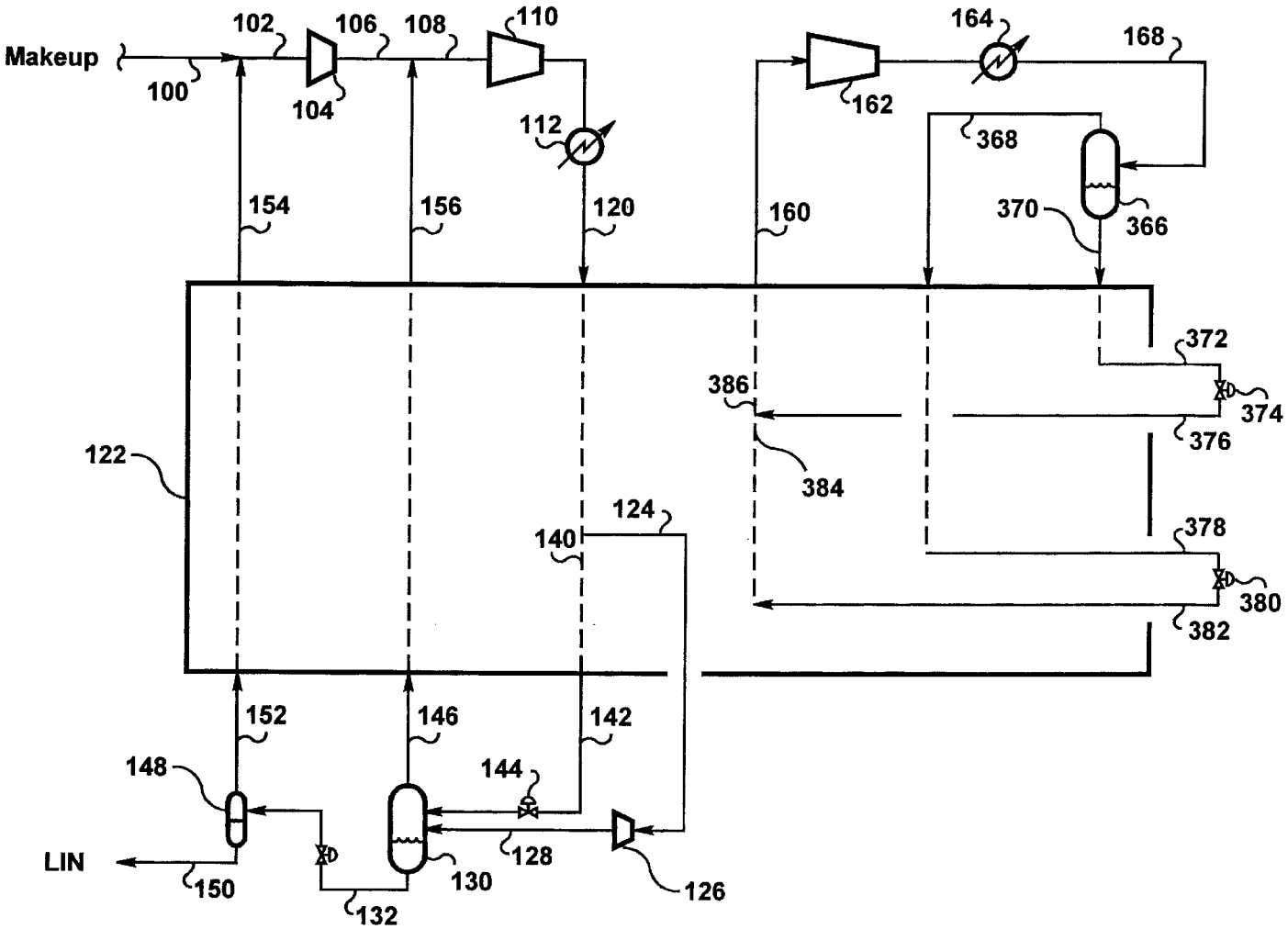
FIG. 3 illustrates another embodiment of the invention in which the closed-loop mixed refrigerant cycle provides refrigeration by separating a compressed, partially-condensed refrigerant into vapor and liquid streams which are cooled and reduced in pressure in two separate heat exchange circuits.

FIG. 3 illustrates another embodiment of the invention. The operation of the nitrogen cycle of FIG. 3 is unchanged from the embodiment of FIG. 1 which utilizes items 100 to 156. Mixed refrigerant recycle stream 160 is compressed in mixed-refrigerant compressor 162, partially condensed in exchanger 164 to form stream 168, and introduced to phase separator 366. Liquid stream 370, enriched in the less volatile components, is withdrawn from phase separator 366, cooled in liquefaction heat exchanger 122 to produce stream 372, and reduced in pressure across valve 374 to form stream 376. Vapor stream 368 from phase separator 366, which is enriched in more volatile components, is cooled and at least partially condensed, preferably totally condensed, in liquefaction heat exchanger 122 to produce stream 378. Stream 378 is reduced in pressure across valve 380 to produce stream 382 which is typically at a temperature less than about 45° F., preferably less than about −125° F., and more preferably less than about −175° F.

Stream 382 is vaporized and warmed in liquefaction heat exchanger 122 to provide refrigeration therein and produce stream 384, which is combined with stream 376 to form stream 386. This combined stream is further vaporized and warmed to provide additional refrigeration therein and produce mixed refrigerant recycle stream 160. This embodiment is an improvement over the embodiment of FIG. 1, because splitting mixed refrigerant stream 168 into more volatile and less volatile fractions allows refrigeration to be produced more efficiently at colder temperatures.

Figure 4:
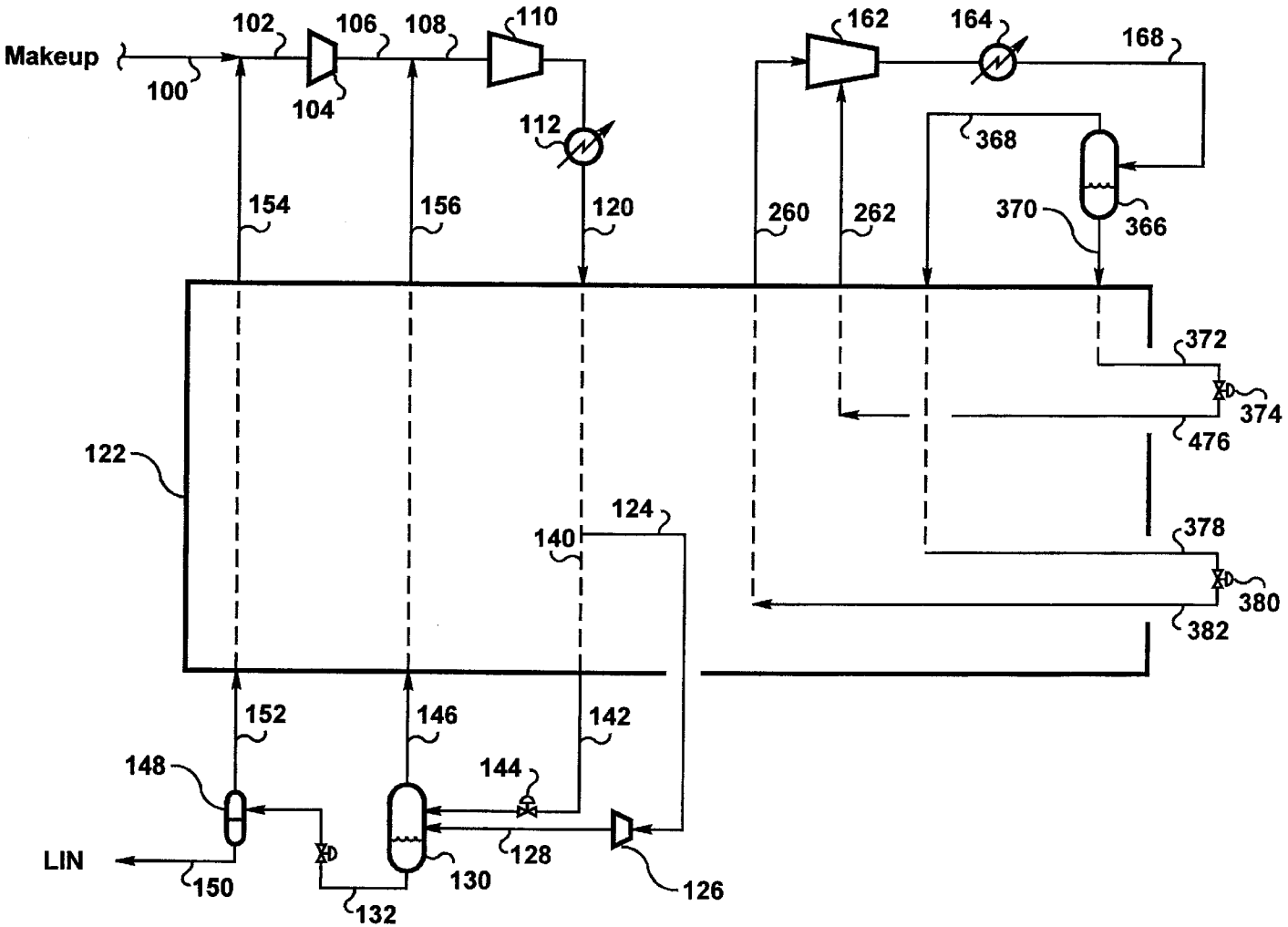
FIG. 4 illustrates another embodiment of the invention in which the closed-loop mixed refrigerant cycle provides refrigeration by separating a compressed, partially-condensed refrigerant into vapor and liquid streams which are cooled and reduced in pressure in two separate heat exchange circuits at two different pressure levels.

Another embodiment is shown in FIG. 4 as a modification to the embodiment of FIG. 3. The operation of the nitrogen cycle in FIG. 4 is unchanged from the embodiment of FIG. 1 which utilizes items 100 to 156. Compressed and partially condensed mixed refrigerant stream 168 is introduced to phase separator 366. Liquid stream 370, enriched in the less volatile components, is withdrawn from phase separator 366, cooled in liquefaction heat exchanger 122 to produce stream 372, and reduced in pressure across valve 374 to form stream 476. Stream 476 is subsequently vaporized and warmed in exchanger 122 to produce additional refrigeration therein, and is introduced into mixed refrigerant compressor 162 as stream 262.

Vapor stream 368 from phase separator 366, which is enriched in more volatile components, is cooled in exchanger 122 to a colder temperature than stream 372 to produce stream 378. This stream is reduced in pressure across valve 380 to a pressure less than that of stream 476 to form stream 382. Reduced-pressure stream 382 is at a temperature less than about −45° F., preferably less than about −125° F., and more preferably less than about −175° F. Stream 382 is subsequently vaporized and warmed in exchanger 122 to produce additional refrigeration therein, and is introduced into mixed refrigerant compressor 162 as stream 260.

Figure 5:
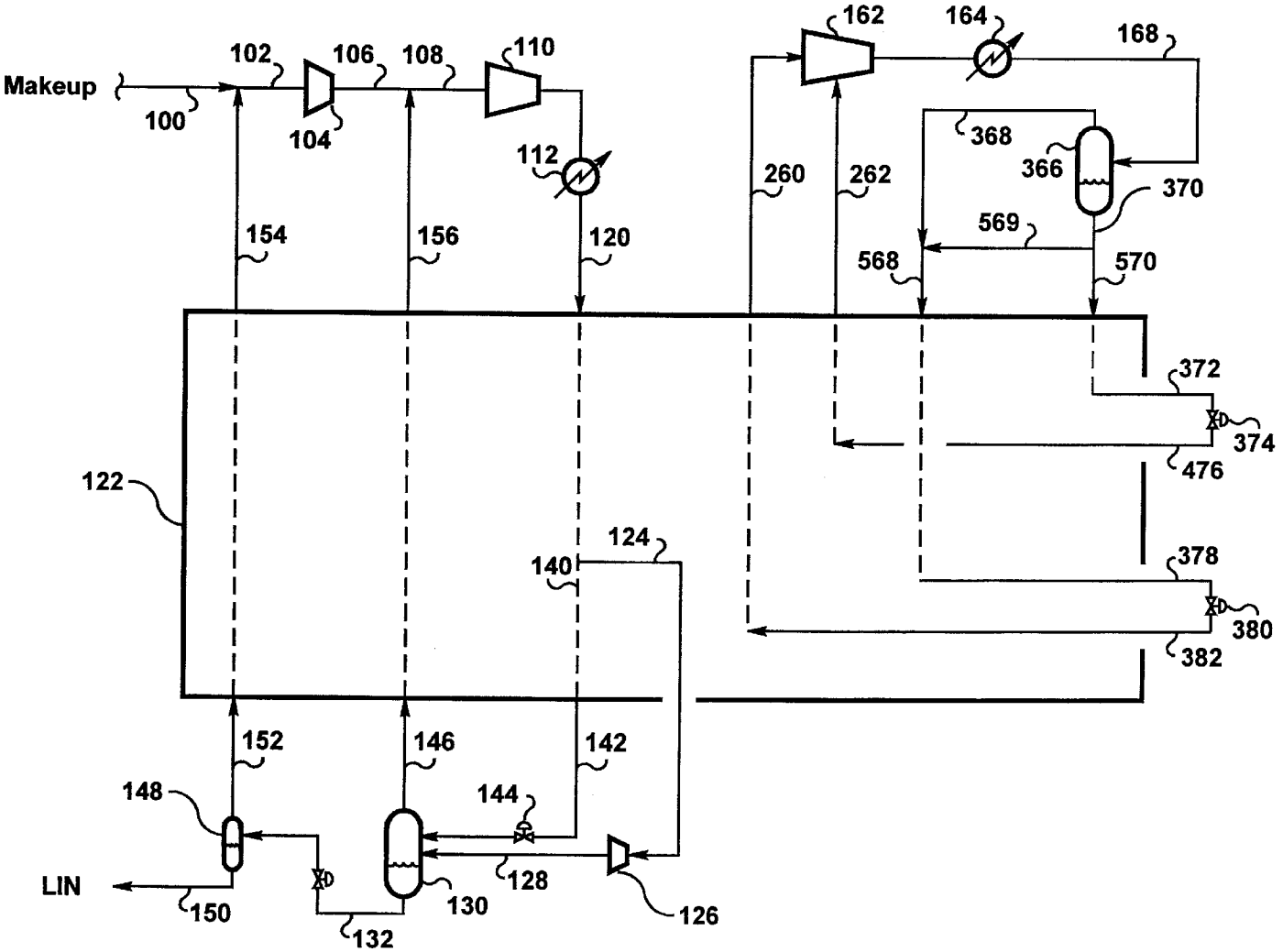
FIG. 5 illustrates another embodiment of the invention similar to the embodiment of FIG. 4 in which a portion of the refrigerant liquid stream is combined with the refrigerant vapor stream before cooling.

FIG. 5 describes an improvement to the embodiment of by FIG. 4. The operation of the nitrogen cycle in FIG. 5 is unchanged from the embodiment of FIG. 1 which utilizes items 100 to 156. Compressed and partially condensed mixed refrigerant stream 168 is introduced to phase separator 366. Liquid stream 370 is withdrawn from phase separator 366 and split into streams 569 and 570. Stream 570 is cooled in liquefaction heat exchanger 122 to produce stream 372 and reduced in pressure across valve 374 to form stream 476. Stream 476 is subsequently vaporized and warmed in exchanger 122 to produce refrigeration therein and is introduced into mixed refrigerant compressor 162 as stream 262.

Vapor stream 368 from phase separator 366 is combined with stream 569 to form stream 568. Stream 568 is subsequently cooled in exchanger 122 to a colder temperature than stream 372 to produce stream 378, which is reduced in pressure across valve 380 to a pressure less than that of stream 476 to form stream 382. Reduced-pressure stream 382 is at a temperature less than about −45° F., preferably less than about −125° F., and more preferably less than about −175° F. Stream 382 is subsequently vaporized and warmed in exchanger 122 to provide additional refrigeration therein, and then is introduced into mixed refrigerant compressor 162 as stream 260. Adding stream 569 to stream 368 allows for fine adjustment of the composition of stream 568.

Figure 6:
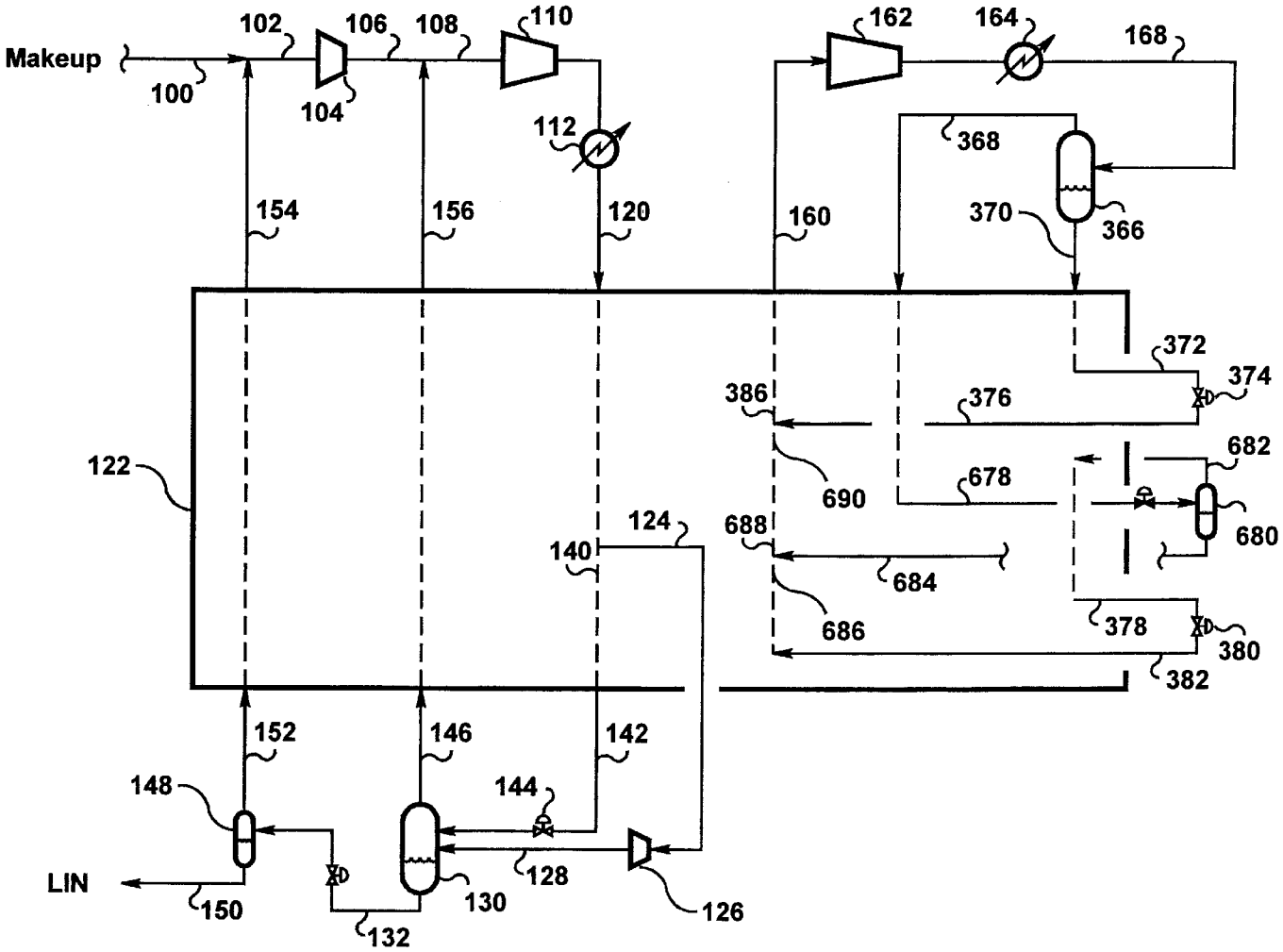
FIG. 6 illustrates another embodiment of the invention similar to the embodiment of FIG. 3 in which a portion of the refrigerant vapor stream, after cooling and pressure reduction, is separated into additional liquid and vapor stream, wherein the additional vapor stream is cooled and reduced in pressure.

Many modest improvements can be made to the embodiments of FIGS. 1 through 5 by adding additional stages of phase separation within the mixed refrigerant cycle. One example is illustrated in FIG. 6, which is an improvement on the process of FIG. 3. The operation of the nitrogen cycle in FIG. 6 is unchanged from the embodiment of FIG. 1 which utilizes items 100 to 156. Mixed refrigerant recycle stream 160 is compressed in mixed refrigerant compressor 162, partially condensed in exchanger 164 to form stream 168, and introduced to phase separator 366. Liquid stream 370, enriched in the less volatile components, is withdrawn from phase separator 366, cooled in liquefaction heat exchanger 122 to produce stream 372, and reduced in pressure across valve 374 to form stream 376.

Vapor stream 368 from phase separator 366, which is enriched in more volatile components, is cooled and at least partially condensed in liquefaction heat exchanger 122 to produce stream 678. Stream 678 is optionally reduced in pressure then passed into phase separator 680 to form vapor stream 682 and liquid stream 684. Stream 682, which is even more enriched in the more volatile components, is further cooled in exchanger 122 to form stream 378. Stream 378 is subsequently reduced in pressure across valve 380 to produce stream 382, which is vaporized and warmed in liquefaction heat exchanger 122 to provide refrigeration and produce intermediate stream 686. Stream 686 is combined with liquid stream 684 from phase separator 680 to form stream 688. Optionally, stream 684 may be cooled prior to being combined with intermediate stream 686. Stream 688 is further vaporized to provide additional refrigeration and form stream 690, which is combined with stream 376 to form stream 386. This stream is vaporized to provide additional refrigeration and is warmed to produce mixed refrigerant recycle stream 160. The addition of separator 680 provides a means of producing a vapor which is further enriched in the more volatile component for use as a refrigerant at colder temperatures than may be efficiently realized by using the embodiment of FIG. 3.

Figure 7:
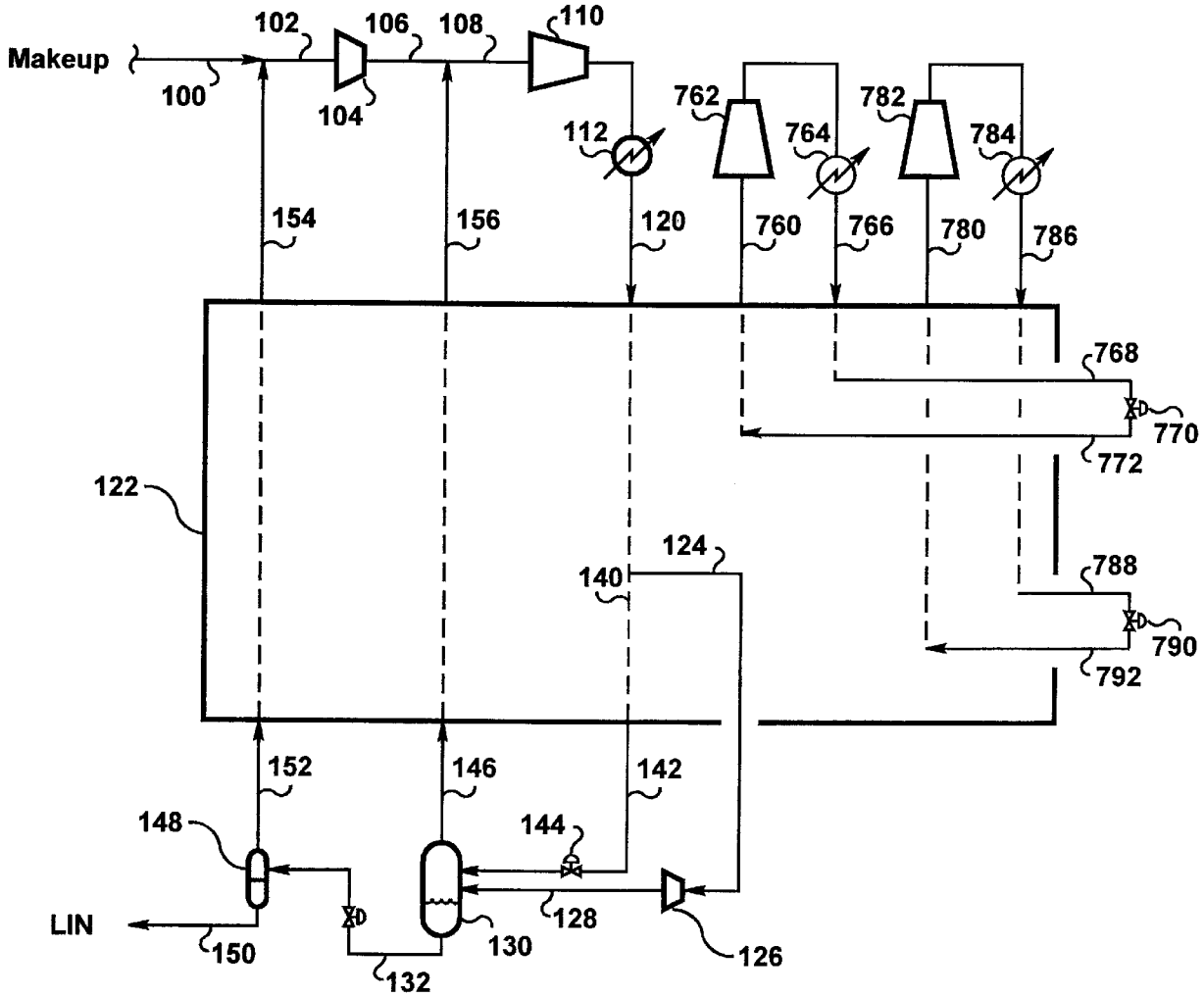
FIG. 7 illustrates another embodiment of the invention which utilizes two independent closed-loop refrigerant cycles.

FIG. 7 presents an alternative embodiment in which cold temperatures may be achieved by using multiple refrigeration cycles with refrigerants of different compositions. The operation of the nitrogen cycle in FIG. 7 is unchanged from the embodiment of FIG. 1 which utilizes items 100 to 156. First refrigerant recycle stream 760 is compressed in first recycle compressor 762 then cooled and at least partially condensed in exchanger 764 to form stream 766. Stream 766 is cooled in exchanger 122 to produce stream 768, then reduced in pressure across valve 770 to form stream 772. Stream 772 is subsequently vaporized and warmed in exchanger 122 to provide refrigeration therein and produce first refrigerant recycle stream 760. Second refrigerant recycle stream 780 is compressed in second recycle compressor 782 and cooled in exchanger 784 to form stream 786. Stream 786 is cooled and condensed in exchanger 122 to produce stream 788, which is colder than stream 768. Stream 788 is reduced in pressure across valve 780 to form stream 782, which is vaporized and warmed in exchanger 122 to provide additional refrigeration therein and produce second refrigerant recycle stream 780. The first refrigerant and second refrigerant may be either pure components or a mixture of components. As described in this embodiment, the volatility of the first refrigerant is less than the volatility of the second refrigerant. The embodiment of FIG. 7 may be easier to operate than the embodiments of FIGS. 3 through 6 in some cases, particularly when the first and second refrigerants are pure components. The disadvantage of the embodiment illustrated by FIG. 7 is that multiple compressors must be used which can result in higher capital cost. When the embodiment of FIG. 7 is implemented using essentially pure refrigerant components, exemplary fluids would be propane for the first refrigerant and ethane (or ethylene) for the second refrigerant. The second refrigerant in the embodiment of FIG. 7 may be divided and the streams vaporized at different pressure levels.

Figure 8:
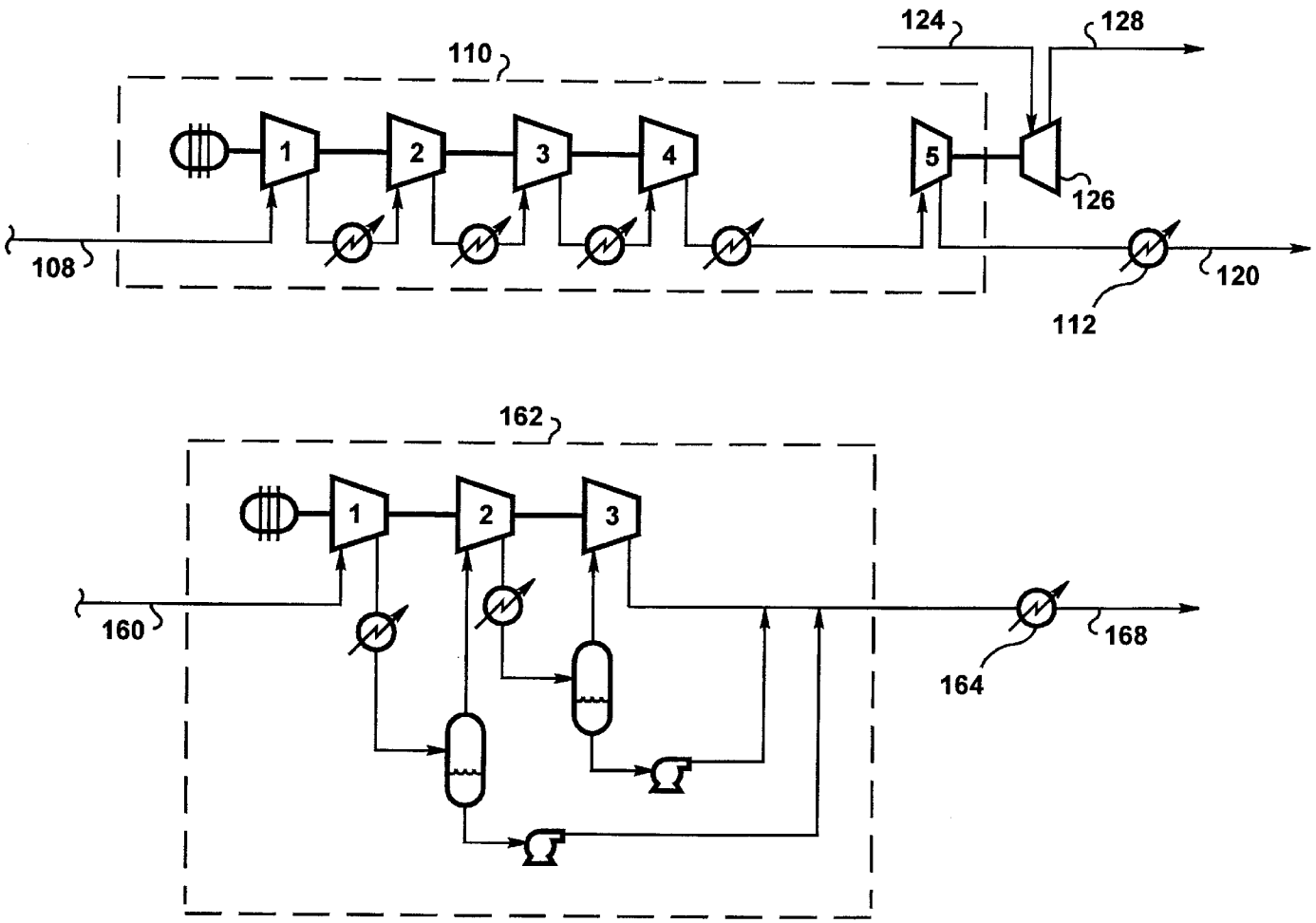
FIG. 8 illustrates another embodiment of the invention in which alternative multi-stage compressors are used for nitrogen and refrigerant compression.

In the preceding disclosure, gas compression was described generically and no detailed discussion was given for the specific compression steps. FIG. 8 illustrates possible compression configurations for the nitrogen compressor (upper diagram) and the refrigerant compressor (lower diagram) as used in the embodiment of FIG. 3. In the nitrogen compressor, combined nitrogen return stream 108 is introduced to the first stage at a typical pressure ranging between 70 and 100 psia. Stream 108 is compressed in multiple stages, in this example 5 stages, and an intercooler is used at the discharge of each of the first 4 stages. It is common practice to drive at least the majority of the compression stages with an electric motor; a steam turbine or a gas turbine optionally can be used. In this example, nitrogen expander 126 drives the fifth stage of nitrogen compression. Following compression, the pressurized nitrogen is cooled in aftercooler 112 to produce stream 120 which is typically at a pressure between 600 and 1500 psia and more typically between 900 and 1250 psia.

Mixed refrigerant recycle compressor 162 is shown in the lower diagram of FIG. 8. Inlet and outlet pressures are highly variable due to a number of factors including composition and refrigerant temperature levels. Typical values for inlet pressure range between 15 psia and 70 psia; typical outlet pressure ranges between 150 psia and 500 psia. Another feature common to mixed refrigerant compression is that the less volatile components, such as butane and pentane, will partially condense from the vapor phase as the fluid is intercooled between compression stages. As a consequence, a phase separator is introduced to recover condensed liquid between stages of compression as shown. These condensed liquids are pumped to compressor discharge pressure and blended with the compressed gas flow leaving the last stage of compression. The mixing of fluids often is performed prior to the final cooling and condensation in exchanger 164, for example. Careful selection of mixed refrigerant composition and adjustments to intercooling and stage compression ratios can allow some or all of the intercooler separators to be eliminated.

The nitrogen cycle used in FIGS. 1 through 7 is but one of many possible configurations. The present invention may utilize any of the known nitrogen cycles which are based on work expansion of a portion of the cooled and compressed nitrogen. For example, although the embodiments described above utilize a single turbo-expander (126), the use of multiple turbo-expanders, and the associated benefit of lower power requirement, may be warranted when power cost is high and/or liquid production is large. Additionally, pressure reduction valve 144 could be replaced with a work-producing expander, often called a "dense fluid expander", for improved efficiency.

The pressure at which the feed gas is liquefied may differ from the inlet pressure to the nitrogen expander if desired. In this case, the pressure of the gas to be liquefied typically would be greater than the pressure of the expander inlet.

The refrigeration cycles described in FIGS. 1 through 7 are not exhaustive. The present invention may be practiced using any single mixed refrigerant, dual mixed refrigerant, or cascade cycles which are based on closed loop operation, use at least two components in the refrigeration cycle or cycles, and employ vaporization of the refrigerant fluid to provide refrigeration. Additionally, the pressure reduction valves employed in the refrigeration cycle, such as valves 374 and 380 in FIG. 3, could be replaced with work-producing expanders for improved efficiency. Furthermore, it is desirable that the refrigerant streams leaving the pressure reduction valves, and entering the liquefaction heat exchanger, be single-phase liquids. Although this may be suboptimal in terms of efficiency, the design of the heat exchanger equipment may be simplified. The compression arrangements illustrated by FIG. 8 are provided for illustration, and are not intended to restrict the scope of the of the invention.

EXAMPLE

The following Example illustrates the embodiment of the present invention shown in FIG. 3 and compares it with a more conventional prior art process of FIG. 9 by means of process heat and material balances. The mixed refrigerant composition for this example, expressed on a molar basis, is 23% methane, 38% ethane, 14% propane, 14% butanes, and 11% pentanes.

FIG. 9 shows a typical, efficient, two expander, nitrogen recycle liquefier process. Low-pressure nitrogen makeup vapor 100 is combined with low-pressure nitrogen recycle stream 154 to form stream 102. Stream 102 is compressed in makeup compressor 104 to form stream 106. Stream 106 is combined with medium pressure nitrogen recycle stream 156 to form stream 108. Stream 108 is compressed in recycle compressor 110, cooled in aftercooler 912, and split into stream 916 and stream 920. Stream 920 is cooled in liquefaction heat exchanger 122 to form stream 922, then expanded in turbo-expander 924. Stream 916 is further compressed in compressor 918 the cooled in aftercooler 112 to form stream 120. Stream 120 is cooled to a temperature that is intermediate the cold-end and warm-end heat exchanger temperature and is split into stream 124 and stream 140. Stream 124 is work expanded in turbo-expander 126 to form stream 128 and is introduced into medium pressure phase separator 130.

Stream 140 is further cooled to produce stream 142 at a temperature below its critical temperature, reduced in pressure across valve 144, and introduced into medium pressure phase separator 130. Vapor stream 146 from the medium pressure phase separator is partially warmed in liquefaction heat exchanger 122 to provide refrigeration and form stream 928, which is combined with stream 926 from turbo-expander 924 and fully warmed to produce additional refrigeration and medium pressure nitrogen recycle stream 156. Liquid stream 132 from the medium pressure phase separator is further reduced in pressure and introduced into low-pressure phase separator 148. Vapor stream 152 from the low-pressure phase separator is warmed in liquefaction heat exchanger 122 to produce the low-pressure nitrogen recycle stream 158. Liquid stream 150 from the low-pressure phase separator constitutes the final liquid nitrogen product.

Comparisons of the embodiment of FIG. 3 with the prior art process of FIG. 9 are given Tables 1 and 2 below.

TABLE 1

STREAM SUMMARY COMPARISON

| | | Present Invention (FIG. 3) | | | Prior Art (FIG. 9) | | |
|---|---|---|---|---|---|---|---|
| Stream No. | Stream Description | Temp., ° F. | Press., psia | Flow, lb mol/hr | T, ° F. | Press., psia | Flow, lb mol/hr |
| 102 | N2 to comp 104 | 89 | 15 | 2551 | 89 | 15 | 2578 |
| 108 | N2 to comp 110 | 88 | 87 | 6184 | 88 | 92 | 11727 |
| 120 | first high pressure N2 | 90 | 1075 | 6184 | 90 | 1241 | 7127 |
| 920 | second high pres. N2 | | | 0 | 90 | 513 | 4600 |
| 124 | N2 to expander 126 | −165 | 1067 | 4426 | −127 | 1233 | 4895 |
| 922 | N2 to expander 924 | | | 0 | 44 | 508 | 4600 |

TABLE 1-continued

STREAM SUMMARY COMPARISON

| Stream No. | Stream Description | Present Invention (FIG. 3) Temp., ° F. | Press., psia | Flow, lb mol/hr | Prior Art (FIG. 9) T, ° F. | Press., psia | Flow, lb mol/hr |
|---|---|---|---|---|---|---|---|
| 142 | high pressure cold N2 | −288 | 1065 | 1752 | −286 | 1231 | 2232 |
| 150 | liquid N2 product | −315 | 20 | 2083 | −315 | 20 | 2083 |
| 160 | MR to comp 162 | 87 | 40 | 2515 | | 0 | |
| 368 | MR vapor from 366 | 90 | 275 | 1675 | | | 0 |
| 370 | MR liquid from 370 | 90 | 275 | 840 | | | 0 |
| 372 | MR liq. to valve 374 | −63 | 270 | 840 | | | 0 |
| 378 | MR vap. To valve 380 | −202 | 271 | 1675 | | | 0 |

TABLE 2

POWER COMPARISON

| Item Number | Item Name | Present Invention (FIG. 3) Power, kW | Prior Art (FIG. 9) Power, kW |
|---|---|---|---|
| 104 | Power input to 104 | 2,119 | 2,203 |
| 110 | Power input to 110 | 6,488 | 10,866 |
| 162 | Power input to 162 | 1,727 | 0 |
| 126 | credit from 126 | (801) | (1,142) |
| 924 | credit from 924 | 0 | (1,572) |
| | total power required | 9,533 | 10,355 |
| | installed machinery | 11,135 | 15,783 |

The results from this worked example show that the present invention consumes 8.5% less power than conventional prior art technology. Furthermore, the installed machinery power, which is a component of capital cost, is 30% less for the present invention.

Thus the present invention provides a process for gas liquefaction, particularly nitrogen liquefaction, which combines the use of a nitrogen autorefrigeration cooling cycle with one or more closed-loop refrigeration cycles using two or more refrigerant components. The closed-loop or recirculating refrigeration cycle or cycles provide refrigeration in a temperature range having a lowest temperature typically between about −45° F. and about −250° F. A nitrogen expander cycle provides additional refrigeration, a portion of which is provided at temperatures below the lowest temperature of the closed-loop or recirculating refrigeration cycle or cycles. The lowest temperature of the nitrogen expander cycle refrigeration range is typically between about −220° F. and about −320° F. The combined use of the two different refrigerant systems allows each system to operate most efficiently in the optimum temperature range, thereby reducing the power consumption required for liquefaction.

The essential characteristics of the present invention are described completely in the foregoing disclosure. One skilled in the art can understand the invention and make various modifications without departing from the basic spirit of the invention, and without deviating from the scope and equivalents of the claims which follow.

What is claimed is:

1. A method of providing refrigeration for the liquefaction of a feed gas which comprises:

(a) providing a first refrigeration system comprising at least one recirculating refrigerant circuit, wherein the first refrigeration system utilizes a mixed refrigerant comprising two or more components and provides refrigeration in a first temperature range, and operating the first refrigeration system by utilizing steps which include (a1) compressing a gaseous mixed refrigerant to provide a compressed mixed refrigerant;

(a2) cooling and at least partially condensing the compressed mixed refrigerant in a first heat exchanger to provide a cooled mixed refrigerant;

(a3) further cooling at least a portion of the cooled mixed refrigerant in a second heat exchanger to provide a further cooled mixed refrigerant;

(a4) reducing the pressure of the further cooled mixed refrigerant to provide a reduced-pressure mixed refrigerant;

(a5) warming and vaporizing the reduced-pressure mixed refrigerant in the second heat exchanger to provide a portion of the refrigeration required for the liquefaction of the feed gas and yield a vaporized mixed refrigerant; and (a6) recirculating the vaporized mixed refrigerant to provide at least a portion of the gaseous mixed refrigerant in (a1); and (b) providing a second refrigeration system in which a cooled and pressurized refrigerant stream is work expanded to generate a cold refrigerant stream, and warming the cold refrigerant stream in the second heat exchanger to provide another portion of the refrigeration required for the liquefaction of the feed gas, wherein the cooled and pressurized refrigerant stream comprises feed gas and has the same composition as the feed gas;

wherein the first refrigeration system comprises a recirculating refrigeration circuit which is operated by steps which include:

(1) compressing a gaseous mixed refrigerant to form a compressed gaseous mixed refrigerant;

(2) cooling and at least partially condensing a first portion of the compressed gaseous mixed refrigerant to form a first cooled mixed refrigerant;

(3) reducing the pressure of the first cooled mixed refrigerant to a first pressure level to form a first reduced-pressure mixed refrigerant;

(4) vaporizing the first reduced-pressure mixed refrigerant of (3) to provide a first portion of the refrigeration in the first temperature range and yield a first vaporized refrigerant;

(5) cooling and at least partially condensing a second portion of the compressed gaseous mixed refrigerant to form a second cooled mixed refrigerant;

(6) reducing the pressure of the second cooled mixed refrigerant to a second level to form a second reduced-pressure mixed refrigerant;

(7) vaporizing the second reduced-pressure mixed refrigerant to provide a second portion of the refrigeration in the first temperature range and form a second vaporized refrigerant;

(8) compressing the second vaporized refrigerant and combining it with the first vaporized refrigerant to form a combined compressed vaporized refrigerant; and (9) further compressing the combined vaporized refrigerant to provide the gaseous mixed refrigerant of (1).

2. The method of claim 1 wherein the lowest temperature in the second temperature range is less than the lowest temperature in the first temperature range.

3. The method of claim 2 wherein the lowest temperature in the first temperature range is between about −125° F. and about −250° F.

4. The method of claim 3 wherein the lowest temperature in the second temperature range is between about −220° F. and about −320° F.

5. The method of claim 2 wherein the feed gas comprises nitrogen.

6. The method of claim 5 wherein the nitrogen concentration in the feed gas is equal to or greater than the concentration of nitrogen in air.

7. The method of claim 1 wherein the mixed refrigerant comprises two or more components selected from the group consisting of nitrogen and hydrocarbons containing one or more carbon atoms.

8. A method of providing refrigeration for the liquefaction of a feed gas which comprises:

(a) providing a first refrigeration system comprising at least one recirculating refrigerant circuit, wherein the first refrigeration system utilizes a mixed refrigerant comprising two or more components and provides refrigeration in a first temperature range, and operating the first refrigeration system by utilizing steps which include (a1) compressing a gaseous mixed refrigerant to provide a compressed mixed refrigerant;

(a2) cooling and at least partially condensing the compressed mixed refrigerant in a first heat exchanger to provide a cooled mixed refrigerant;

(a3) further cooling at least a portion of the cooled mixed refrigerant in a second heat exchanger to provide a further cooled mixed refrigerant;

(a4) reducing the pressure of the further cooled mixed refrigerant to provide a reduced-pressure mixed refrigerant;

(a5) warming and vaporizing the reduced-pressure mixed refrigerant in the second heat exchanger to provide a portion of the refrigeration required for the liquefaction of the feed gas and yield a vaporized mixed refrigerant; and (a6) recirculating the vaporized mixed refrigerant to provide at least a portion of the gaseous mixed refrigerant in (a1); and (b) providing a second refrigeration system in which a cooled and pressurized refrigerant stream is work expanded to generate a cold refrigerant stream, and warming the cold refrigerant stream in the second heat exchanger to provide another portion of the refrigeration required for the liquefaction of the feed gas, wherein the cooled and pressurized refrigerant stream comprises feed gas and has the same composition as the feed gas;

wherein the first refrigeration system comprises a recirculating refrigeration circuit which is operated by steps which include:

(1) compressing a gaseous mixed refrigerant;

(2) cooling, partially condensing, and separating the resulting compressed mixed refrigerant into a liquid refrigerant stream and a vapor refrigerant stream;

(3) further cooling and reducing the pressure of the liquid refrigerant stream to yield a first cooled reduced-pressure refrigerant stream;

(4) cooling, at least partially condensing, and reducing the pressure of the cooled vapor refrigerant stream to yield a second cooled reduced-pressure refrigerant stream;

(5) warming the second cooled reduced-pressure refrigerant stream to provide a portion of the refrigeration in the first temperature range and yield a warmed second reduced-pressure refrigerant stream;

(6) combining the first cooled reduced-pressure refrigerant stream and the warmed second reduced-pressure refrigerant stream, and warming the resulting combined refrigerant stream to provide another portion of the refrigeration in the first temperature range; and (7) recirculating the resulting warmed combined refrigerant stream to provide the gaseous mixed refrigerant of (1).

9. The method of claim 1 wherein the resulting compressed mixed refrigerant is cooled, partially condensed, and separated into a liquid stream and a vapor stream, and wherein the liquid stream provides the first portion of the resulting compressed mixed refrigerant and the vapor stream provides the second portion of the resulting compressed mixed refrigerant.

10. The method of claim 9 wherein a portion of the liquid stream is combined with the second portion of the resulting compressed mixed refrigerant.

11. A method of providing refrigeration for the liquefaction of a feed gas which comprises:

(a) providing a first refrigeration system comprising at least one recirculating refrigerant circuit, wherein the first refrigeration system utilizes a mixed refrigerant comprising two or more components and provides refrigeration in a first temperature range, and operating the first refrigeration system by utilizing steps which include (a1) compressing a gaseous mixed refrigerant to provide a compressed mixed refrigerant;

(a2) cooling and at least partially condensing the compressed mixed refrigerant in a first heat exchanger to provide a cooled mixed refrigerant;

(a3) further cooling at least a portion of the cooled mixed refrigerant in a second heat exchanger to provide a further cooled mixed refrigerant;

(a4) reducing the pressure of the further cooled mixed refrigerant to provide a reduced-pressure mixed refrigerant;

(a5) warming and vaporizing the reduced-pressure mixed refrigerant in the second heat exchanger to provide a portion of the refrigeration required for the liquefaction of the feed gas and yield a vaporized mixed refrigerant; and (a6) recirculating the vaporized mixed refrigerant to provide at least a portion of the gaseous mixed refrigerant in (a1); and (b) providing a second refrigeration system in which a cooled and pressurized refrigerant stream is work expanded to generate a cold refrigerant stream, and warming the cold refrigerant stream in the second heat exchanger to provide another portion of the refrigeration required for the liquefaction of the feed gas, wherein the cooled and pressurized refrigerant stream comprises feed gas and has the same composition as the feed gas;

wherein the first refrigeration system comprises a recirculating refrigeration circuit which is operated by steps which include:

(1) compressing a gaseous mixed refrigerant;

(2) cooling, partially condensing, and separating the resulting compressed mixed refrigerant into a first liquid refrigerant stream and a first vapor refrigerant stream;

(3) further cooling and reducing the pressure of the first liquid refrigerant stream to yield a first cooled refrigerant stream;

(4) cooling and partially condensing the first vapor refrigerant stream, and separating the resulting stream to yield a second liquid refrigerant stream and a second vapor refrigerant stream;

(5) cooling, at least partially condensing, and reducing the pressure of the second vapor refrigerant stream to yield a second cooled refrigerant stream;

(6) warming the second cooled refrigerant stream to provide a portion of the refrigeration in the first temperature range and yield a first warmed refrigerant stream;

(7) combining the first warmed refrigerant stream with the second cooled refrigerant stream, and warming the resulting combined refrigerant stream to provide another portion of the refrigeration in the first temperature range and yield a second warmed refrigerant stream;

(8) combining the second warmed refrigerant stream with first cooled refrigerant stream, and warming the resulting combined refrigerant stream to provide yet another portion of the refrigeration in the first temperature range and yield a third warmed refrigerant stream; and (9) recirculating the third warmed refrigerant stream to provide the gaseous mixed refrigerant of (1).

12. A method of providing refrigeration for the liquefaction of a feed gas which comprises:

(a) providing a first refrigeration system comprising at least one recirculating refrigerant circuit, wherein the first refrigeration system utilizes a mixed refrigerant comprising two or more components and provides refrigeration in a first temperature range, and operating the first refrigeration system by utilizing steps which include (a1) compressing a gaseous mixed refrigerant to provide a compressed mixed refrigerant;

(a2) cooling and at least partially condensing the compressed mixed refrigerant in a first heat exchanger to provide a cooled mixed refrigerant;

(a3) further cooling at least a portion of the cooled mixed refrigerant in a second heat exchanger to provide a further cooled mixed refrigerant;

(a4) reducing the pressure of the further cooled mixed refrigerant to provide a reduced-pressure mixed refrigerant;

(a5) warming and vaporizing the reduced-pressure mixed refrigerant in the second heat exchanger to provide a portion of the refrigeration required for the liquefaction of the feed gas and yield a vaporized mixed refrigerant; and (a6) recirculating the vaporized mixed refrigerant to provide at least a portion of the gaseous mixed refrigerant in (a1); and (b) providing a second refrigeration system in which a cooled and pressurized refrigerant stream is work expanded to generate a cold refrigerant stream, and warming the cold refrigerant stream in the s heat exchanger to provide another portion of the refrigeration required for the liquefaction of the feed gas, wherein the cooled and pressurized refrigerant stream comprises feed gas and has the same composition as the feed gas;

wherein the second recirculating refrigeration circuit is operated by steps which include:

(1) compressing and cooling a first gas stream comprising feed gas to provide a cooled compressed gas stream;

(2) work expanding a first portion of the cooled compressed gas stream to provide at least a portion of the cold refrigerant in (b);

(3) warming the cold refrigerant to provide refrigeration in the second temperature range and yield a warmed refrigerant;

(4) recirculating the warmed refrigerant to provide a portion of the first gas stream in (1);

(5) further cooling a second portion of the cooled compressed gas stream to provide a cold compressed gas stream, reducing the pressure of the cold compressed gas stream to yield a reduced-pressure stream which is at least partially liquefied, introducing the reduced-pressure stream into a separator vessel, and withdrawing a stream of liquefied gas therefrom; and (6) providing another portion of the first gas stream in (1) by a gas makeup stream which comprises feed gas.

13. The method of claim 12 wherein the resulting work-expanded gas in (2) is introduced into the separator vessel and a vapor stream is withdrawn therefrom to provide at least a portion of the cold refrigerant of (b).

14. The method of claim 13 which further comprises reducing the pressure of the stream of liquefied gas, introducing the resulting reduced-pressure stream into another separator vessel, withdrawing therefrom a final liquefied gas product and a cold vapor stream, warming the cold vapor stream to provide another portion of the total refrigeration for liquefaction of the feed gas, combining the resulting warmed vapor stream with the feed gas, and compressing the resulting combined gas stream to provide the gas makeup stream.

* * * * *

UNITED STATES PATENT AND TRADEMARK OFFICE

CERTIFICATE OF CORRECTION

PATENT NO. : 6,298,688 B1
DATED : October 9, 2001
INVENTOR(S) : Brostow et al.

It is certified that error appears in the above-identified patent and that said Letters Patent is hereby corrected as shown below:

Column 20,
Line 18, delete "s" and substitute therefore -- second --.

Signed and Sealed this

Fifth Day of March, 2002

*Attest:*

*Attesting Officer*

JAMES E. ROGAN
*Director of the United States Patent and Trademark Office*